US007823528B2

(12) United States Patent
Stevens

(10) Patent No.: US 7,823,528 B2
(45) Date of Patent: Nov. 2, 2010

(54) VESTINE MOTIF UNIQUE BOOKMARKS

(75) Inventor: LaTheasa Vestine Stevens, Austin, TX (US)

(73) Assignee: LaTheasa Stevens

( * ) Notice: Subject to any disclaimer, the term of this patent is extended or adjusted under 35 U.S.C. 154(b) by 185 days.

(21) Appl. No.: 12/009,287

(22) Filed: Mar. 11, 2008

(65) Prior Publication Data

US 2010/0007129 A1 Jan. 14, 2010

(51) Int. Cl.
*B42D 9/00* (2006.01)

(52) U.S. Cl. ..... 116/234; 116/238

(58) Field of Classification Search ..... 116/234–240; 281/42; D19/34

See application file for complete search history.

(56) References Cited

U.S. PATENT DOCUMENTS 838,386 A * 12/1906 Crouch ..... 116/234
1,809,943 A * 6/1931 Ockenden ..... 116/239
2,645,197 A * 7/1953 Jones et al. ..... 116/238
3,143,998 A * 8/1964 Madden ..... 116/238
5,458,081 A * 10/1995 Reichert ..... 116/234
6,854,417 B2 * 2/2005 Stephens ..... 116/238
7,004,106 B1 * 2/2006 Forance ..... 116/238
2004/0069207 A1 * 4/2004 Forance ..... 116/238
2008/0018092 A1 * 1/2008 Zeller et al. ..... 281/42

* cited by examiner

*Primary Examiner*—Amy Cohen Johnson

(57) ABSTRACT

A bookmark comprising a metal rod member having hooks on each end to support the arrangement of bead members. A top and bottom double ring is mounted on the hooks of the metal rod. The top double ring member mounts the circular end of the crimp member. The clamp side of the crimp member attaches to the ribbon material member. The ribbon material members are used to be placed between the pages of the book. The elastic cord member which is used to attach to the book is pulled through the top and bottom double ring member and overlaps to form two slip knots. The clamp side of the crimp member mounts to the elastic cord ends of the two slip knots to keep the skip knot ends attached.

1 Claim, 2 Drawing Sheets

VESTINE MOTIF UNIQUE BOOKMARKS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF INVENTION

There are many noticeable problems with standard adjustable bookmarks. Some problems exist when bookmarks are made to be inserted inside the spine of the book which can wear down the book's edges; and can easily fall off the book loosing the user's desired page. This is just as ineffective as placing a strip of paper loosely between pages. Some standard bookmarks are made with thin wire which can also tear into the book's cover and pages. The most common problems to standard adjustable bookmarks are using beads as anchors or adjusters. Using beads in this manner can cause undesirable friction to the bead itself which over time can destroy the bead and disassemble the bookmark.

BRIEF SUMMARY OF THE INVENTION

The summary of the invention relates to an elongated metal rod with closed hooks on both ends to secure a selected style of beads which are visible on the spine of the book. Attached to both hook ends is one double-ring. The top double ring attaches a desirable amount of crimps whereas a long ribbon material is secured and used to be placed between the pages of the book.

The elastic cord is pulled through the top double ring and then through the bottom double ring. The elastic cord ends are both slip-knotted for adjustability. The loose ends that mildly protrude from the slip knots are sealed with crimps to maximize support to the slip knots. The elastic cord can then be adjusted to stretch around various sized books by placing the adjustable side of the elastic cord inside the front cover and the other side of the elastic cord fits inside the rear cover of the book.

BRIEF DESCRIPTION OF THE INVENTION

Figure 3:
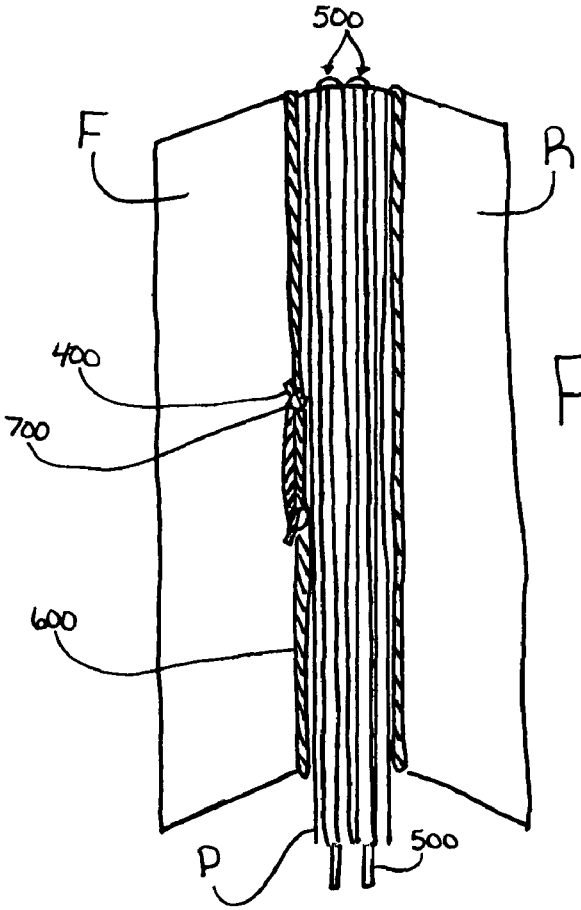

FIG. 3 is an elongated perspective view of an open book illustrating the elastic cords positioned inside the front cover and inside the rear cover of a book. The elastic cords are shaded to show cord texture. The ribbon materials are darkened to show color.

Figure 4:
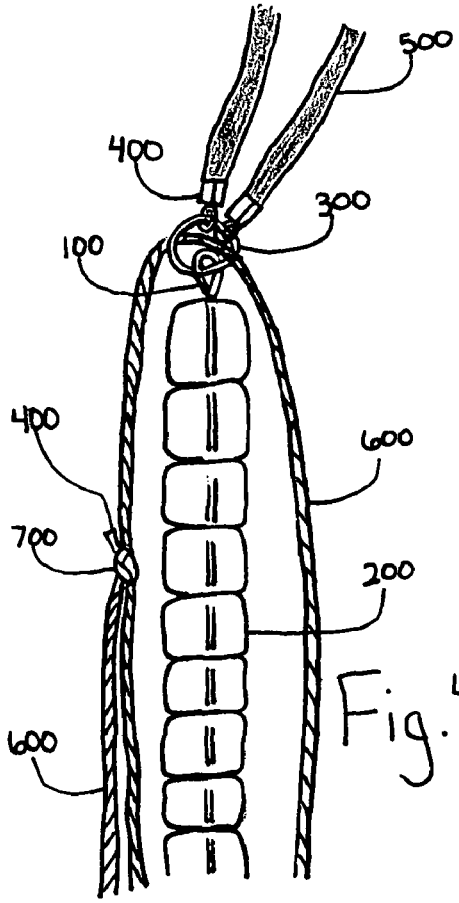

FIG. 4 is a partial enlarged view of the invention. The metal rod is showing an arrangement of lines between the beads. The top double ring, crimps, ribbon material which are darkened to show color, elastic cord which is shaded to show cord texture, and the top slip knot with a crimp end attachment are enlarged for partial view of the invention.

DETAILED DESCRIPTION OF THE INVENTION

Figure 1:
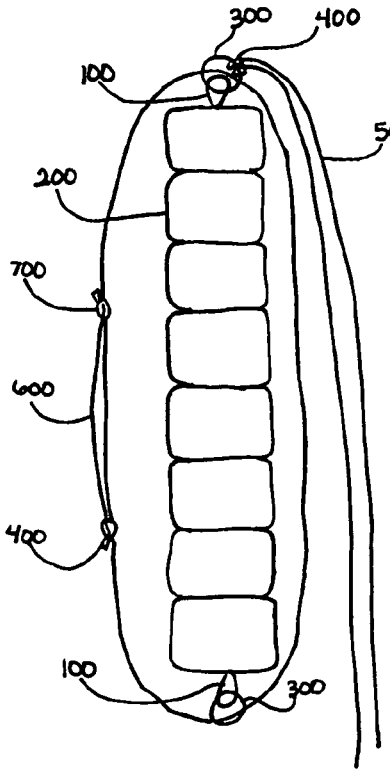
FIG. 1 is an elongated perspective view of the entire invention.

FIG. 1 illustrates the full view of the invention. The implements of the invention begins with the metal rod 100 measuring a desired length with ¼ inch hook formed on one end of metal rod 100. Slide desired arrangement of beads 200 onto metal rod 100 leaving ½ inch space at the end of the metal rod 100 to form a ¼ inch hook to secure the beads 200. Attach one double ring 300 to both hook ends of metal rod 100. Using a desired amount, secure the circular end of crimp 400 to one double ring 300. The clamp end of the crimp 400 grips the ribbon material 500 measuring four inches longer than metal rod 100. This is now considered the top view of FIG. 1. Measure and cut the elastic cord 600 to loosely pull through the top double ring 300 and then pulled through the bottom double ring 300 until the elastic cord 600 overlaps itself by six inches. The overlapping ends of the elastic cord 600 are open to the left of the invention creating a top and bottom cord 600 end. Form the first slip knot 700 by lining the bottom cord 600 end against the body of the top cord 600. Wrap the said cord 600 end around the front of the body of the cord 600 end and back around. A loop is formed around both cords 600. Guide the said cord 600 end through the front of the loop and pull the said cord 600 end tightly through the loop. There will be about ¼ inch of the cord 600 end protruding from the first slip knot 700. Rotate the invention to prepare to make the second slip knot 700. Form the second slip knot 700 by lining the open cord 600 end against the body of the cord 600. Wrap the said cord 600 end around the front of the body of the cord 600 end and back around. A loop is formed around both cords 600. Guide the said cord 600 end through the front of the loop and pull the said cord 600 end tightly through the loop. There will be about ¼ inch of the cord 600 end protruding from the second slip knot 700. Reposition the invention right side up. The clamp end of the crimp 400 is attached to the protruding end of the first and second slip knot 700 for support. The circular end of the crimp 400 and any remaining cord 600 end are trimmed for appearance.

Figure 2:
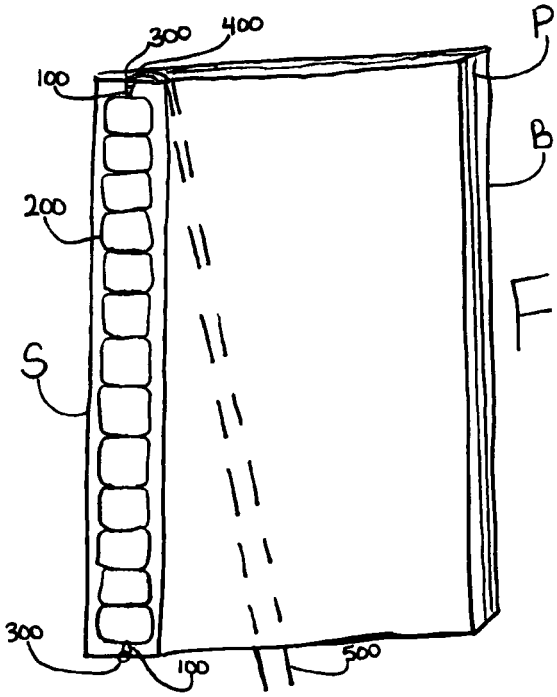
FIG. 2 is an elongated perspective view of the invention on a book in side view. Showing the arrangement of lines for the ribbon material between the pages of the book.

FIG. 2 illustrates FIG. 1 securely placed on a book B. The arrangement of lines are showing the ribbon material 500 between the pages P of the book B. The beads 200 are along the spine S of the book B. The top and bottom double ring 300 are supporting the elastic cord 600 which are inside the front F and rear R cover of the book B. The crimp 400 allows the ribbon material 500 the mobility to move between the select pages P of the book B. The length of the ribbon material 500 is measured to hang a few inches below the book's B bottom edges.

FIG. 3 illustrates the elastic cord 600 between the front F inside cover and rear R inside cover of the book B. The invention is positioned on the book B by pulling the front F cover of the book B through the elastic cords 600. The elastic cord 600 has a rear support and an adjustable side whereas the slip knots 700 are located. The rear support elastic cord 600 is stretched over all the pages P of the book B or like and positioned inside the rear R cover of the book B. The adjustable side of the elastic cord 600 remains inside the front F cover of the book B. The arrangement of beads 200 remains visible at the spine S of the book B. The length of the ribbon material 500 is measured to hang a few inches below the book's B bottom edges. Tighten the fit of FIG. 1 to a book B by firmly holding one slip knot 700 and with your opposite hand pull on one of the inside cords 600. The inside cords 600 are those located between the slip knots 700. The slip knots 700 will be propelled away causing the elastic cord 600 to be shortened. Loosen the fit of FIG. 1 by firmly holding one slip knot 700 and with the opposite hand pull on the outside cord 600. The outside cord 600 is those located outside the slip knots 700. The slip knots 700 will come together causing the elastic cord 600 to increase in size.

FIG. 4 illustrates a partial enlarged view of the top portion of FIG. 1. The arrangement of lines through the beads 200 represent the metal rod 100 following through the holes of the beads 200. The hook on the metal rod 100 attaches to the top double ring 300. The circular end of the crimp 400 attaches to the top double ring 300. The clamp end of the crimp 400 grips the ribbon material 500. The ribbon material 500 is darkened to show color. The elastic cord 600 is pulled through the top double ring 300. The double cords 600 show the overlapping of the cord 600 end to form the slip knot 700. The clamp end of the crimp 400 is attached to the protruding end of the slip knot 700. The circular end of the crimp 400 and any remaining cord 600 end is trimmed to secure the slip knot from detaching.

I claim:

1. A metal rod based adjustable bookmark that is made to securely fit any hardcover or paperback book comprising;

a thin metal rod member with closed hooks formed on each end of said metal rod member that is securing any style bead arrangement;

with one double-ring member attached on each hook of said metal rod member including;

multiple crimp members each having attached one strand of ribbon material connected onto one said double-ring member which represents the top of said thin metal rod member; and a single strand of an elastic cord member measuring ¾ greater the size of the said metal rod member which is pulled through the top then bottom of said double-ring members having overlapping ends open on the left side of said metal rod member;

a slip knot is applied to both ends of said elastic cord member; and a crimp member seal the end tips of said elastic cord member which is used to secure both slip knots on said elastic cord member.

* * * * *